United States Patent [19]

Lyons

[11] Patent Number: 4,567,616

[45] Date of Patent: Feb. 4, 1986

[54] MULTI-PURPOSE HAND TOOL APPLICATOR

[75] Inventor: John E. Lyons, Levittown, N.Y.

[73] Assignee: Eutectic Corporation, Flushing, N.Y.

[21] Appl. No.: 698,697

[22] Filed: Feb. 6, 1985

[51] Int. Cl.[4] ..... E04F 21/00; B25G 1/02

[52] U.S. Cl. ..... 7/105; 16/116 R; 30/162; 30/169; 30/340; 15/111

[58] Field of Search ..... 7/105; 30/329, 330, 30/331, 332, 162, 340, 136, 172, 169; 16/116 R; 15/111

[56] References Cited

U.S. PATENT DOCUMENTS

| | | | |
|---|---|---|---|
| 367,228 | 7/1887 | Orbold | 7/105 |
| 494,516 | 3/1893 | Walton | 7/105 |
| 494,921 | 4/1893 | Hayward | 7/105 |
| 510,775 | 12/1893 | Christy | 30/162 |
| 655,007 | 7/1900 | Rairigh | 7/105 |
| 1,908,834 | 5/1933 | Engberg | 16/116 R |
| 2,060,415 | 11/1936 | Helgason | 7/105 X |
| 2,655,963 | 10/1953 | Dell | 16/116 R |
| 3,051,975 | 9/1962 | Schwartz | 15/111 X |
| 3,147,840 | 9/1964 | Brookhouser | 15/111 X |
| 3,189,069 | 6/1965 | Stowell | 16/116 R |
| 4,209,865 | 7/1980 | Kozlowski | 7/105 |
| 4,327,465 | 5/1982 | Moritsch | 30/340 |

*Primary Examiner*—Jimmy C. Peters

*Attorney, Agent, or Firm*—Hopgood, Calimafde, Kalil, Blaustein & Judlowe

[57] ABSTRACT

A multi-purpose hand tool applicator is provided for applying coating material to a surface. The tool comprises an elongated handle having a blade-receiving slot longitudinally disposed therein for detachably receiving one of a plurality of applicator blades each having a male portion for insertion into the handle and an applicator portion opposite the male portion, the handle having means for detachably holding the blade against dislodgement during use. The multi-purpose tool has at least a first blade having an applicator portion in the form of a straight edge and a contoured edge portion characterized by at least one radius of curvature, at least a second blade having an applicator portion in the form of an edge transverse to and opposite to the male portion, and at least a third blade having an applicator portion rotatably mounted to the male portion and capable of being set in one of a plurality of radial positions, the blade being made of flexible material and being characterized by at least one right angled edge and at least one edge having a radius of curvature, whereby the multi-purpose hand tool is capable of being used to apply coating material to flat surfaces, to concave surfaces and to convex surfaces.

8 Claims, 9 Drawing Figures

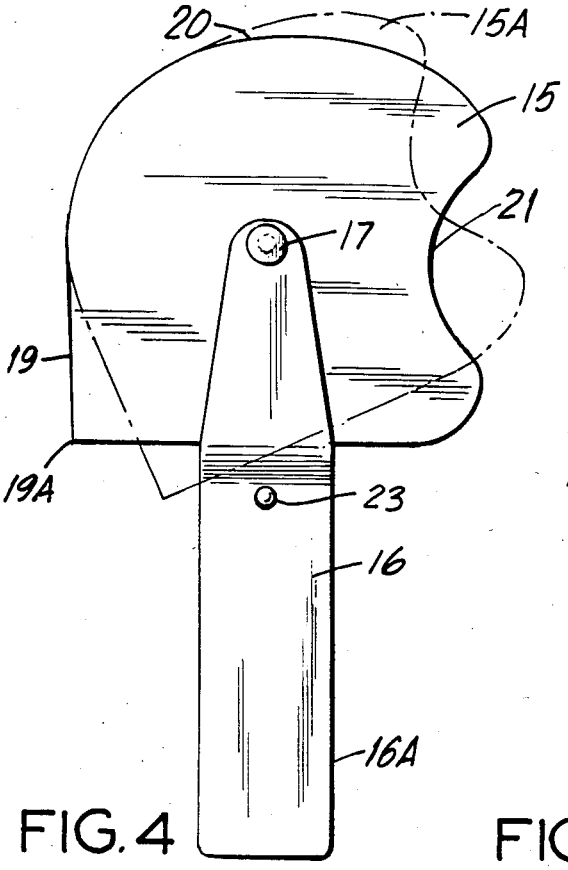
FIG. 4
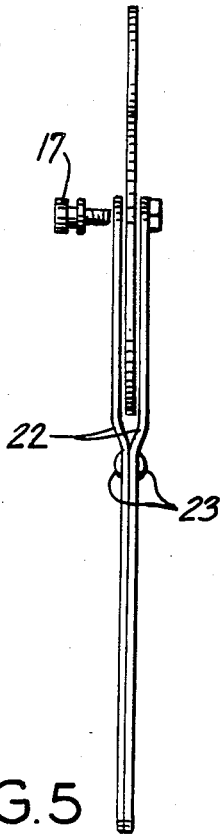
FIG. 5
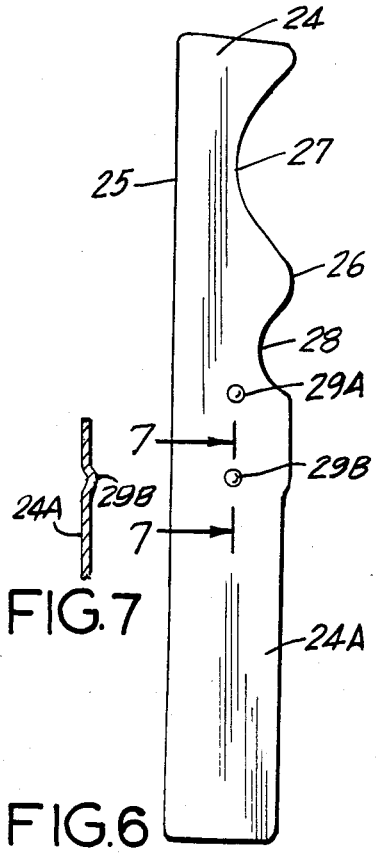
FIG. 7
FIG. 6
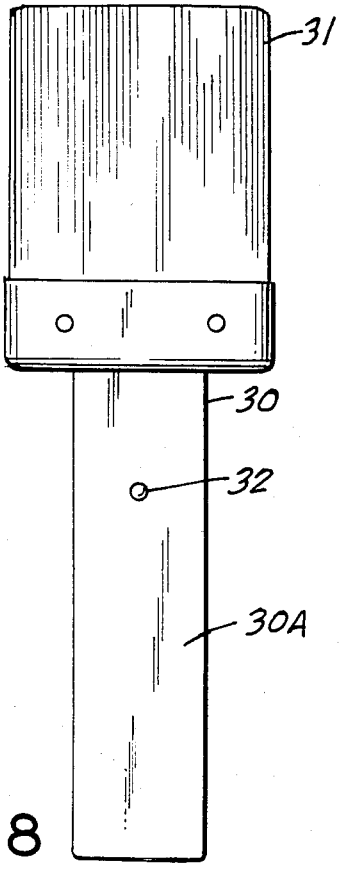
FIG. 8
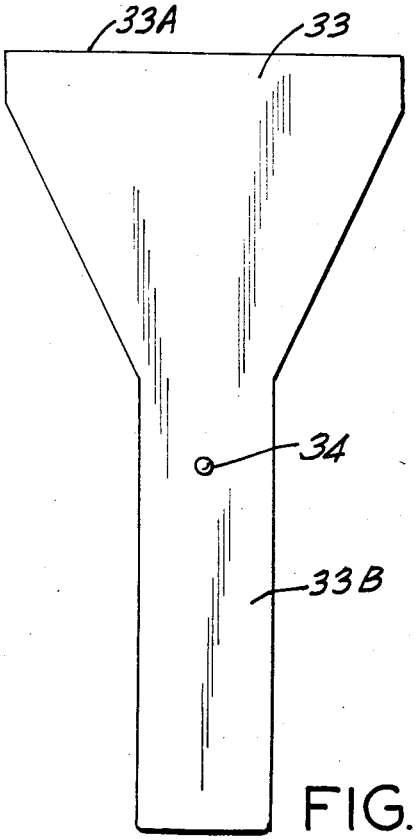
FIG. 9

MULTI-PURPOSE HAND TOOL APPLICATOR

This invention relates to a multi-purpose hand tool applicator for applying coating material to surfaces of different shapes and contours.

BACKGROUND OF THE INVENTION

Combination tools are known in which a handle is employed for use with one of a plurality of working tools, such as cutting tools. For example, in U.S. Pat. No. 1,559,780, which issued on Nov. 3, 1935, a combination tool is described comprised of a plurality of cutting tools normally arranged in a two-part handle. One of the tools is mounted for sliding movement and is adapted to be extended beyond one end of the handle, while the other tool is pivotally mounted and adapted to extend perpendicularly from the opposite end of the handle, the handle being designed to permit access to either of the tools. The handle cooperates with means carried by the tools for holding the latter fixed with regard to the handle in their given positions.

Thus, one of the tools is a bottle cap remover and has in combination therewith at its end a screw driver portion. Another tool is a knife blade. The back end of the handle is characterized by a pivotally mounted hatchet with its home position within the handle and which is pivoted outwardly of the handle and indexed in a position perpendicular to it. All the tool elements are confined within the handle and are adapted to be readily and easily extended to a position for use and subsequently locked in a working position against movement relative to the handle.

A combination implement is disclosed in U.S. Pat. No. 1,776,443 comprising a wire brush and a scraper, a hammer head, a bit or other desired tool whose shank comprises a handle for the brush and a tubular sheath or sleeve slidable with respect to the brush and the tool shank. The brush consists of a quantity of wires attached to a stock having a ferrule in which the ends of the wires are grouped and fixed to provide an extended brush portion opposite to the fixed end, the stock being confined in a tubular sheath, which also serves as a handle. Thus, the brush may extend from one end of the handle, while other tool elements may be mounted at the other end such as a hammer head, a hooked shank, a bit or a flat scraper, etc., each of the tool elements being capable of being indexed in one of several longitudinal positions. The sheath may have a side handle attached laterally thereto.

Other combination tools are known, such as a utensil kit. One such kit is disclosed in U.S. Pat. No. 2,516,458. A fork, a spoon, and a table knife are all capable of being fitted into the handle of a can opener which together make up the kit. The handle of each of the utensils has a convexed dent with its underside concaved. The handles of each of the utensils mate or are indexed together via the dents, the group in turn fitting into the handle of the can opener which has a concave dent on a wall thereof which mates with the exposed convexed dent of the group.

In the field of the surface maintenance of metals, wherein certain types of protective coatings are applied to a surface, e.g., curable plastic compositions, such as epoxy resins containing metal powder, metal surfaces of various shapes and contours are encountered. Such surfaces may be flat, concaved, or convexed or comprise a combination of such surfaces. Generally such coatings are applied using any tool that is available, such as a spatula or the like. Because metal surfaces can have a variety of shapes and contours, it would be desirable to have a multi-purpose tool capable of use with various metal surface shapes.

OBJECTS OF THE INVENTION

It is an object of the invention to provide a multi-purpose hand tool for applying a protective coating to metal surfaces.

Another object is to provide a multi-purpose hand tool for applying protective plastic, coatings to metal surfaces characterized by a variety of shapes and contours.

These and other objects will more clearly appear when taken in conjunction with the following disclosure, the claims and the accompanying drawings, wherein:

FIG. 4 shows one embodiment of a flexible blade pivotally mounted onto a male element for insertion in the handle of FIG. 2;

FIG. 5 is a side view in elevation of the embodiment shown in FIG. 4 showing the relationship of the handle to the flexible blade pivotally mounted thereto;

FIG. 6 depicts another embodiment of a blade in which the working portion thereof is comprised of a straight edge on one side and a contoured edge on the other side characterized by at least one radius of curvature;

FIG. 7 is a partial cross section of FIG. 6 showing a convexed dimple for coacting with a corresponding concaved dimple in the handle;

FIG. 8 depicts a blade with a brush extending from one end thereof; and

FIG. 9 is a blade having a broad transverse edge for use as a spatula in spreading a plastic coating over a flat surface.

SUMMARY OF THE INVENTION

Stating it broadly, the invention is directed to a multi-purpose hand tool applicator for applying a protective coating material to a surface such as a non-metallic surface or a metal surface. One embodiment comprises an elongated handle having a blade-receiving slot longitudinally disposed therein for detachably receiving one of a plurality of applicator blades, each of said blades having a male portion for insertion into said handle and an applicator portion opposite said male portion, the handle having means for detachably holding the blade against dislodgement during use. The hand tool includes at least a first blade having an applicator portion in the form of a straight edge and a contoured edge portion characterized by at least one radius of curvature; at least a second blade having an applicator portion in the form of an edge transverse to and opposite to said male portion; and at least a third blade having an applicator portion rotatably mounted to the male portion and capable of being set in one of a plurality of radial positions, the blade being made of flexible material and being characterized by at least one right angled edge and at least one edge having a radius of curvature.

An advantage of the multi-purpose hand tool is that it is capable of being used to apply coating material to flat surfaces, to concave surfaces and to convex surfaces.

A preferred embodiment of at least the first blade is one in which the radius of curvature of the contoured edge defines either a concave edge or a convex edge or one which has several radii of curvature defining at least one concave edge and at least one convex edge.

A further embodiment is one in which the transverse edge of at least the second blade is defined by a brush used to apply coating material in the form of a thick liquid to a surface.

Another embodiment is one in which the radius of curvature of at least the third blade of flexible material defines a convex edge having particular use in coating the internal surface of a hollow cylinder.

DETAILS OF THE INVENTION

Figure 1:
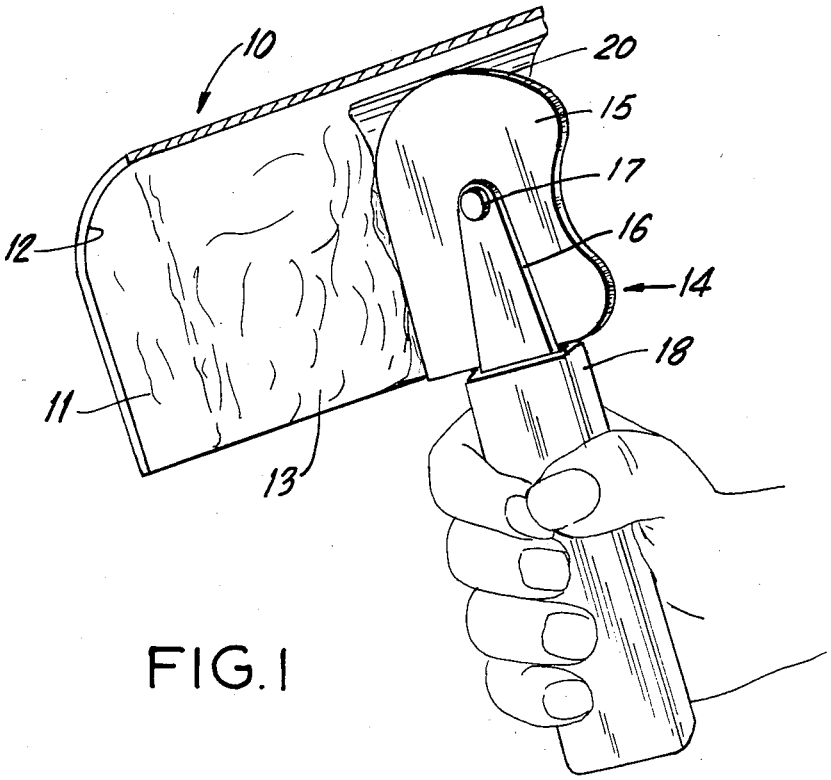
FIG. 1 is a partial perspective showing the use of one embodiment of a tool for spreading a plastic composition along both a flat surface and a curved surface extending tangentially from the flat surface.

Referring to FIGS. 1, 4 and 5, a portion of a metal part 10 to be coated is shown having a flat surface 11 which is continuous with and is tangential to curved surface 12. The total inner surface of the part is covered with a curable resin or plastic of putty-like consistency by spreading the plastic along both the flat and curved portions of the surface using the multi-purpose tool 14 having a blade 15 pivotally mounted to a blade support 16 at pivot mount 17 (FIG. 4), the support being made of two strips of metal joined together in face-to-face contact (FIG. 5), each being stepped at 22 to provide a bifurcated structure defining a slot therebetween for freely receiving blade 15 therein and being pivotally mounted via pin 17 and nut 17A. The male portion 16A is insertable into handle 18. The step or shoulder at 22 provides stop means for preventing the blade from rotating once it has been set in a particular working position.

The pivotally mounted blade 15 is shown in FIG. 4 in one fixed position and a phantom view 15A to illustrate the pivotal transition to the next position. As will be noted, the flexible blade which is preferably made of polypropylene has a right cornered edge 19A, a straight edge 19, a substantially uniform curved edge 10 having a convex contour of a particular radius of curvature and a concave edge 21 of another radius of curvature. Thus, the flexible polypropylene blade has a right angled edge 19A for spreading a plastic coating along the inner right angled corner of the metal part, a straight edge 19 for spreading plastic over a flat surface (note FIG. 1) and curved edges 20 and 21 for spreading plastic against concaved and convexed surfaces, respectively.

The bifurcated support which is resiliently compressible has a pair of oppositely disposed dimples 23 for lockingly cooperating with corresponding concave dedents 23A in handle 18 (FIGS. 2 and 3), the handle having a blade-receiving slot 18A disposed longitudinally therein containing said concave dedents 23A. The locking in of the blade is achieved by friction fitting, such that the male portion 16A of the blade support 16 is detachably insertable into the handle, the bifurcated portion being sufficiently compressible as stated hereinabove for detachably inserting the support into the slot.

FIG. 6 depicts another embodiment of a blade 24 characterized by a straight edge 25 and a contoured edge 26 having two radii of curvature 27, 28, respectively, for spreading a plastic composition (e.g., a phenolic resin) over a shaft having a radius of curvature corresponding to either of curves 27 or 28. The blade has two spaced dimples 29A, 29B for setting the blade in one of two longitudinal positions, depending on the portion of the blade to be used, that is, curve 27 or curve 28, the male portion 24A being insertable into the handle.

Figure 2:
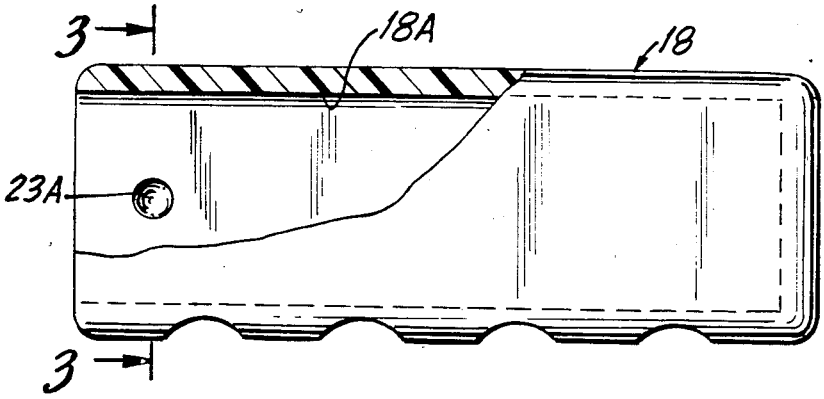
FIG. 2 depicts a handle partially broken away characterized by a blade-receiving slot having means therein for lockingly engaging the male portion of a blade inserted therein.
Figure 3:
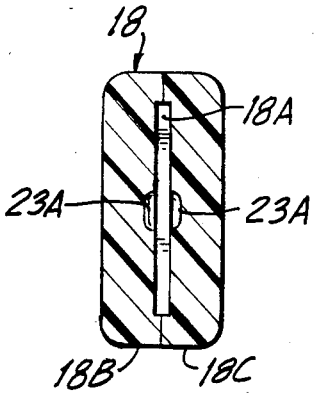
FIG. 3 is a cross section of the handle of FIG. 2 taken along line 3—3.

FIGS. 8 and 9 are further embodiments of blades for use with handle 18 shown in FIGS. 2 and 3. Blade 30 has a brush 31 at its forward end and is provided with a locking dimple 32 at the male portion 30A for locking the blade in position when the male portion is inserted into slot 18A of handle 18. The brush is used for spreading a liquid solution of a curable plastic composition such as an epoxy resin or phenolic resin, onto a metal surface to be protected.

The spatula of FIG. 9 has a working blade portion 33, a male portion 33B, and a dimple 34 for locking the blade in position when inserted into the handle. The spatula has a transverse edge 33A which is used to spread the putty-like plastic over flat surfaces. Handle 18, which is generally made of plastic has sufficient resilience to enable the detachable insertion of the blade support into the slot of the handle. The handle is preferably made of two resilient parts 18B, 18C joined together.

Although the present invention has been described in conjunction with the preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A multi-purpose hand tool applicator for applying a protective coating material to a surface which comprises:

an elongated handle having a blade-receiving slot longitudinally disposed therein for detachably receiving one of a plurality of applicator blades each having a male portion for insertion into said handle and an applicator portion opposite said male portion, said handle having means for detachably holding said blade against dislodgement during use, at least a first blade having an applicator portion in the form of a straight edge and a contoured edge portion characterized by at least one radius of curvature;

at least a second blade having an applicator portion in the form of an edge transverse to and opposite to said male portion, and at least a third blade having an applicator portion pivotally mounted to a bifurcated support and capable of being set in one of a plurality of radial positions within a space defined by the bifurcated portion of the support, said blade being made of flexible material and being characterized by at least one right angled edge and at least one edge having a radius of curvature, whereby said multi-purpose hand tool is capable of being used to apply coating material to flat surfaces, to concave surfaces and to convex surfaces.

2. The multi-purpose hand tool of claim 1, wherein at least said first blade has a contoured edge in which the radius of curvature defines either a concave edge or a convex edge.

3. The multi-purpose hand tool of claim 1, wherein at least said first blade has a contoured edge with several radii of curvature defining at least one concave edge and at least one convex edge.

4. The multi-purpose hand tool of claim 1, wherein the transverse edge of at least said second blade is defined by a brush used to apply coating material to a surface.

5. The multi-purpose hand tool of claim 1, wherein the radius of curvature of at least the third blade of flexible material defines a convex edge having particular use in the coating of the internal diameter of an internal cylindrical surface.

6. The multi-purpose tool of claim 1, wherein at least said first blade has a contoured edge in which the radius of curvature defines either a concave edge or a convex edge;

wherein the transverse edge of at least said second blade is defined by a brush used to apply coating material to a surface; and wherein the radius of curvature of at least the third blade of flexible material defines a convex edge having a particular use in the coating of internal diameter of an internal cylindrical surface.

7. The multi-purpose hand tool according to claim 1, wherein the bifurcated portion of the support for the third blade is made of two strips of material joined together in face-to-face contact, the two strips being stepped to provide a space therebetween for receiving the blade, the bifurcated support being sufficiently compressible to enable the detachable insertion of the blade support into the handle, the stepped portion providing a shoulder for preventing the rotation of the blade during the use thereof in a predetermined position.

8. The multi-purpose hand tool of claim 1, wherein said handle is formed of two parts of resilient plastic joined together, each of the parts having a dedent, one opposite the other, for lockingly coacting with means on the male portion of the blade in the form of opposed convexed dimples which frictionally enter the dedent.

* * * * *